United States Patent [19]

Fiorentino et al.

[11] Patent Number: 4,462,234

[45] Date of Patent: Jul. 31, 1984

[54] RAPID EXTRUSION OF HOT-SHORT-SENSITIVE ALLOYS

[75] Inventors: Robert J. Fiorentino, Worthington; E. Garland Smith, Jr., Columbus, both of Ohio

[73] Assignee: Battelle Development Corporation, Columbus, Ohio

[21] Appl. No.: 265,891

[22] Filed: Jun. 1, 1981

Related U.S. Application Data

[63] Continuation-in-part of Ser. No. 161,019, Jun. 19, 1980, abandoned.

[51] Int. Cl.[3] ..... B21C 23/08; B21C 23/32; B21C 25/02; B21C 29/04

[52] U.S. Cl. ..... 72/41; 72/253.1; 72/264; 72/273.5; 72/342; 72/700

[58] Field of Search ..... 72/253.1, 60, 41, 342, 72/364, 700, 273.5, 264; 148/11.5 A

[56] References Cited

U.S. PATENT DOCUMENTS

| | | | |
|---|---|---|---|
| 2,135,193 | 11/1938 | Moorhead | 72/253.1 |
| 2,907,454 | 10/1959 | Sejournet | 72/467 |
| 3,112,828 | 12/1963 | Zipf | 72/253.1 |
| 3,344,636 | 10/1967 | Pugh | 72/271 |
| 3,364,707 | 1/1968 | Foerster | 72/342 |
| 3,553,996 | 1/1971 | Sabroff et al. | 72/253.1 |
| 3,808,865 | 5/1974 | Wagner et al. | 72/342 |
| 3,999,415 | 12/1976 | Austen | 72/253.1 |
| 4,346,578 | 8/1982 | Harrison et al. | 72/253.1 |

FOREIGN PATENT DOCUMENTS

| | | | |
|---|---|---|---|
| 218001 | 11/1956 | Australia | 72/253.1 |
| 429376 | 5/1926 | Fed. Rep. of Germany | 72/253.1 |
| 183170 | 6/1966 | U.S.S.R. | 72/342 |

OTHER PUBLICATIONS

The Extrusion of Metals, by Pearson & Parkins, 2nd ed., 1960; pp. 112–117, 162–169, 190–199, 242–253.

*Primary Examiner*—Lowell A. Larson
*Attorney, Agent, or Firm*—Barry S. Bissell

[57] ABSTRACT

High-strength aluminum alloys and other hot-short-sensitive alloys can be extruded at rapid rates through a cooled, double reduction die (3) without hot-short cracking or scoring caused by die pickup. A primary reduction die (4) has a long, cooled primary land (5) and is followed by a secondary reduction die (6). A metal billet (15) may be extruded through the primary die (4) at about the solidus temperature of its lowest melting phase, then cooled as it passes through the primary die land (5) to reduce or maintain the temperature below the solidus temperature and, finally, the primary extrusion is reduced in cross section in the secondary die (6) by about 2–50%. The temperature, the back pressure caused by the second reduction, and the low friction through the primary land (5) contribute to eliminate hot-short cracks and minimize serious pickup scoring at surprising rates of at least about 18 meters per minute (60 ft/min) for 2024 aluminum rod.

11 Claims, 4 Drawing Figures

RAPID EXTRUSION OF HOT-SHORT-SENSITIVE ALLOYS

RELATED APPLICATION

This is a continuation-in-part of our earlier application Ser. No. 161,019, filed June 19, 1980, now abandoned.

BACKGROUND OF THE INVENTION

Two problems encountered in the extrusion of some alloys are hot shortness, evidenced by circumferential cracking, and die pickup which causes longitudinal scoring on the surface of the extruded product. A major cause of hot-short cracking and pickup scoring is the excessive increase in temperature of the extruded product at its surface due to die and container friction. In the case of unlubricated extrusion, billet shearing along the dead-metal-zone surface also contributes to increasing temperature. The high temperature can result in seizing of small particles of the product to the die surface and subsequent scoring thereby of the extrusion. The high surface temperature (exacerbated by the friction of seized particles scoring the surface) may also exceed the solidus temperature of a low-melting phase (e.g., eutectic composition) in the alloy and cause local melting which results in circumferential cracks when acted upon by tensile stresses developed in the extrusion die.

Pressures developed within the billet can raise the solidus temperatures of the phases sufficiently to prevent melting at these high temperatures. However, when the pressure is relieved near the exit of a conventional die, the temperature may then exceed the solidus at the reduced (atmospheric) pressure and melting may occur. Together with the tensile stresses, the melting would then cause cracking.

In the past, extrusion speeds or ratios had to be minimized to prevent the increased friction and excessive billet temperature increases. Conversely, billet preheat temperatures could be reduced in order to allow a margin for higher extrusion speeds and concomitant larger temperature increases in the billet and extrusion within the die. Unfortunately, this often increases extrusion pressures excessively and extrusion ratios must then be reduced to permit extrusion at all.

In addition to the problems mentioned for hot-short-sensitive alloys, there are problems of die wear, product dimensional accuracy and product surface finish which are prevalent in metal extrusions, particularly the high-strength, high-melting-point metals and alloys. These problems may be reduced by lower temperature extrusion, but again, the extrusion pressure is increased.

Of course, prior references reveal the possibility of cooling a die to avoid higher temperatures therein. For example, U.S. Pat. No. 2,135,193 discusses the problem of pickup and proposes a water-cooled die.

U.S. Pat. No. 3,553,996 teaches a method for extruding brittle materials with a crack-free surface. One embodiment of the method includes the use of a double-reduction die similar to the die proposed herein. However, a relief portion is provided therein between reduction die faces. The material problems therein are different than for the hot-short sensitive materials herein and the disclosure does not address this problem.

German Patentschrift No. 429,376 teaches a method of reducing the tearing in extrusions by cooling the die land and by increasing friction in the die by lengthening the die land and by making the long die land slightly converging towards the exit. This German patent attempts to maximize friction in the die land whereas the present inventors have found the opposite conclusion; that friction should be minimized in order to produce a good product at fast rates and minimal extrusion pressures.

SUMMARY OF THE INVENTION

An objective of the invention is to provide a die and method for extrusion of hot-short-sensitive alloys.

Another object of the invention is to provide a die and extrusion method for minimizing cracking and scoring in otherwise susceptible alloys.

Another object is to provide such a die and method which allows extrusion of good products at very high rates of extrusion compared with present rates.

Another object is to provide a die and method which allows a reduction of die wear and/or improves dimensional accuracy and surface finish of extrusions of high-melting-point metals and alloys.

A further object is to enable the above extrusions with lower ram pressures due to decreased friction and increased billet preheat temperatures.

In particular, it is an object of the invention to provide an extrusion die and method for producing commercial alloy rod, bar, tube or other shapes based on aluminum, copper, magnesium, zinc or other hot-short-sensitive alloys at high rates of extrusion.

In accordance with the objectives, the invention is an extrusion die and a method for extruding metals. The extrusion die comprises a double-reduction die having primary and secondary dies in tandem along coincident longitudinal axes. The primary die has an extended land surface leading to the secondary die. The secondary die has a more conventional land length and reduces the primary extrusion by, for example, ¼–60%, but preferably about 2–50%, and more preferably 2–15%, in cross section. The novel extrusion die also has cooling means in cooperation with the primary die land and optionally the secondary die land for cooling the lands and, indirectly, the primary and secondary extrusion product passing therethrough in contact with the lands.

For conventional unlubricated extrusion processes, i.e., where lubrication between the billet and container is not used, the primary die face may be a shear or flat surface (180° included angle). The secondary die face in this case can also be a flat surface but it can also be convergently tapered (down to as small as 5° included angle) or have a curved surface. For lubricated extrusion processed, whether by conventional or hydrostatic means, the primary die face may be a convergently tapered or curved surface or a combination conical/flat configuration so as to prevent formation of a dead-metal zone and subsurface entrapment of the lubricant on the extruded product. In this instance, the secondary die face is preferably a convergently tapered or curved surface for the same reason. Multiple as well as single extrusions can be made through dies made for that purpose and according to the invention.

The primary die land is designed to be much longer than normal. Its length-to-diameter (or circumscribed circle) ratio is selected to allow cooling of the extrusion to the desired level. For solid, round products the ratio is chosed between about 1:1 to 12:1, preferably about 1:1 to 5:1. For a 1.27 cm (0.5 inch) diameter solid product, the length would be about 2.0–5 cm (¾–2 inches) and sufficiently long to enable the reduction or maintenance of the temperature of the extruded product below the solidus temperature of its lowest melting phase at the in situ pressure (preferably below the solidus at atmospheric pressure) prior to extrusion through the secondary reduction die. The primary die land is preferably straight-walled (neither converging or diverging), but may be somewhat diverging toward the exit to reduce die-land friction as long as sufficient contact with the extruded product is maintained to control the temperature as described above. For products of thin cross section (tubes, plates, shapes), length-to-section thickness may be adjusted to provide the required cooling.

The secondary die land may be conventionally short, for example 1.6–3.2 mm (0.063–0.125 in) and may have a relief area immediately downstream. The secondary die could also be longer and may be cooled if necessary to further maintain or reduce the temperature of the extruded product.

Friction is preferably required as low as possible in the die by polishing the die faces, where billet flow occurs, and die lands to less than about 0.25 μm (10 microinches rms, preferably 0.05 μm (2 microinches) rms and by lubrication in those areas.

The method of extrusion comprises preheating an alloy billet to a preferred extrusion temperature generally below the solidus temperature at atmospheric pressure of its lowest melting phase, extruding the billet through a primary reduction die having an extended land surface, cooling at least a surface region of the extruded alloy product to reduce or maintain the temperature of the extrusion below the solidus temperature while in the primary die land prior to a secondary reduction, and extruding the cooled product through a secondary reduction die downstream of the primary reduction die to produce a back pressure on the extruded product in the primary die land thereby reducing tensile stresses and keeping the extrusion against the primary die land.

In some cases, it may be possible to cool the extrusion product in the primary die to below the solidus temperature at the in situ pressure, but above the solidus at atmospheric pressure, prior to the secondary reduction. In this case cooling of the secondary die must be provided to cool the product below the solidus at atmospheric pressure prior to its exiting the secondary die to the atmosphere.

The primary reduction may be conventional, for example, about 75–99.8%, whereas the secondary reduction may be about ¼–60%, but preferably about 2–50% and more preferably about 2–15%. The die lands and die faces are preferably polished and lubricated to reduce friction.

Cooling is preferably provided to the extrusion product through the primary and secondary die land by cooling channels surrounding the die land and cold fluid circulating therethrough. Optional cooling of the secondary die land permits further cooling of the product to remove the heat of deformation resulting from the secondary reduction. This helps prevent both the hot-short cracking and pickup on the die land. For tubular products, the central mandrel should also be cooled in cooperation with the cooling of the primary and secondary dies.

Cooling of the primary die face by the cooling channels near the die land may also be tolerated as long as cooling of the billet is not so excessive as to raise the extrusion pressure to an unacceptable level. It is, in fact, preferable to allow some cooling at the die face and to keep the preheat temperature of the container, ram (or dummy block) and the primary die face to the minimum necessary to permit extrusion of the desired material and product at such acceptable pressure level. A conical primary die face can be used to eliminate dead metal zones and, when cooled, can beneficially reduce the billet surface temperature as the billet approaches the die land.

DESCRIPTION OF THE INVENTION

Hot-short-sensitive alloys have posed problems in extrusion related to the slow extrusion rates or low billet preheat temperatures necessary to keep the temperature of the extruded product, or at least the surface thereof, from exceeding the solidus temperature of its lowest melting phase. Copper, magnesium, zinc and aluminum base alloys, among others, may be especially prone to hot shortness. Specifically, aluminum alloys of the 2000 and 7000 series are examples of such alloys and the extrusion of these alloys may be aided considerably by the present invention. For example, extrusion rates of at least 4 or 5 times the conventional rates may be used to produce product with good surface finish.

Figure 1:
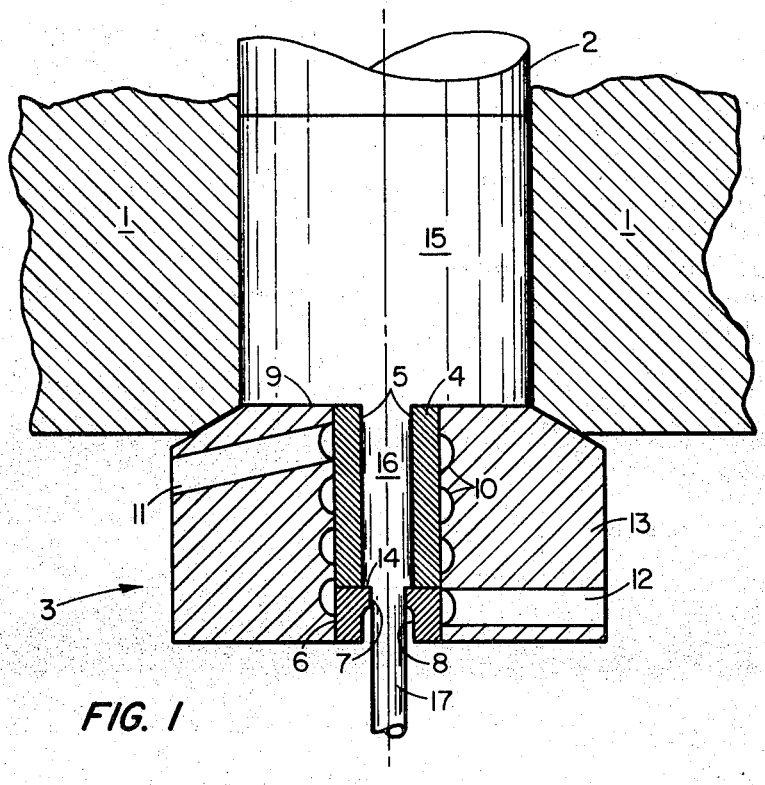
FIG. 1 is a cross-sectional view of a double-reduction, cooled die made according to the invention for extruding solid rod.

Looking at FIG. 1, the inventive cooled, double-reduction (CDR) die 3 is shown positioned against the extrusion apparatus including extruder container 1 (holding billet 15) and ram piston 2. The CDR die 3 includes primary reduction die 4, secondary reduction die 6, die block 13 and cooling channels 10 having a fluid entrance 11 and fluid exit 12 for cooling fluid.

The primary reduction die 4 and the secondary reduction die 6 comprise flat primary 9 and secondary 14 die faces, respectively, and primary 5 and secondary 7 die lands, respectively. The secondary reduction die 6 may also have a relief section 8. The primary and secondary dies are integral and substantially coaxial.

Figure 2:
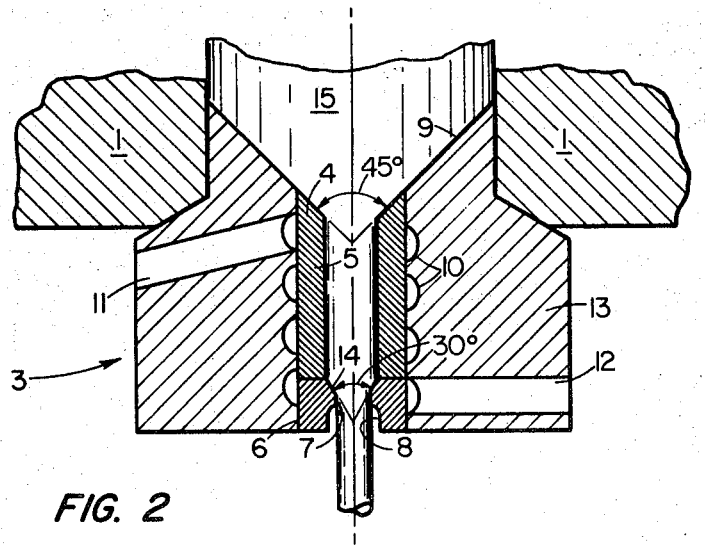
FIG. 2 is a die such as shown in FIG. 1 but having tapered primary and secondary die faces.
Figure 3:
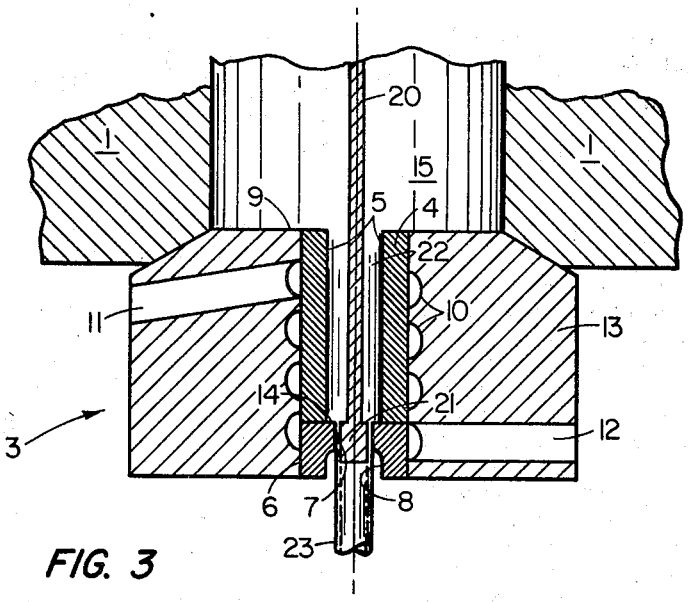
FIG. 3 is a cross-sectional view of a die such as shown in FIG. 1 but having a cooled central mandrel for extruding tubular products.

As shown in FIG. 2, the die faces may also be tapered, although the taper angle is not critical. Included angles of 45° and 30° are exemplified in the figure, however, the die faces could be more or less tapered if desired. Practically speaking, the primary die face is preferably about 45°–180° (included angle) and the secondary die face is preferably 5°–180° (included angle). For unlubricated primary extrusion of aluminum alloys, both die faces are preferably flat or shear faces (180° included angle) as shown in FIG. 1. Other alloys may extrude better with some die taper and lubrication, as known in the art and shown in FIG. 2. The die faces may also be curved rather than having a straight taper.

Figure 4:
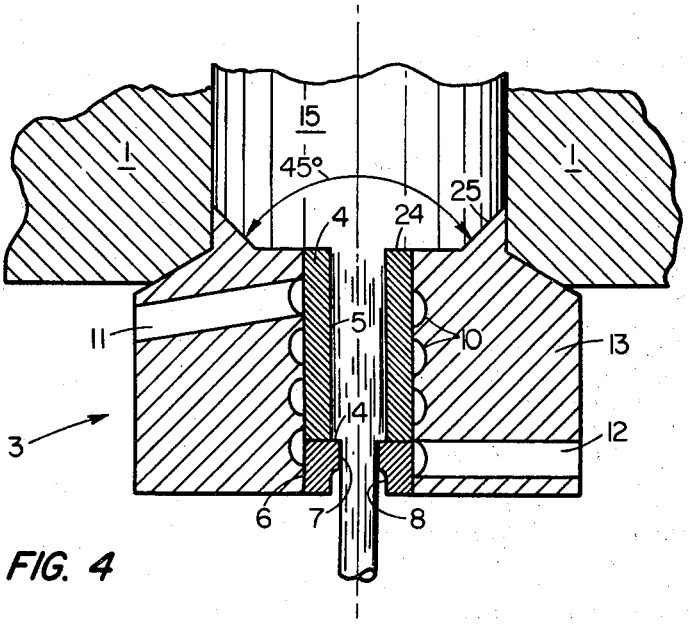
FIG. 4 is a specific embodiment of the die of FIG. 1 wherein the primary die face is of the conical/ flat design.

Whether for lubricated or unlubricated extrusion, the primary die face may also have a combination tapered, flat or curved design. In particular, a conical/flat design such as shown in FIG. 4 may comprise a conical primary die face portion 25 located adjacent the container wall and tapered so as to reduce or eliminate the dead-metal zone in the lower corner of the container thereby minimizing temperature increases in the billet due to friction or internal shearing in that zone. The downstream remaining portion of the primary die face would be a flat (shear) die face 24 or could be slightly tapered, depending on any special requirements for a specific product or billet material.

Although FIGS. 1–4 show only the direct extrusion method where only the ram moves relative to the container and die, the invention could also be used in indirect extrusion where both the die and a hollow ram move relative to the container. For indirect extrusion, the only change to be made is to provide cooling to the die through the hollow ram.

PRIMARY EXTRUSION DIE

Looking again at FIG. 1, the typical cross sectional extrusion ratio of the billet 15 to the primary extruded product 16 is conventional and may be about 4:1 to 500:1. A 40:1 ratio is typical for many alloys included herein.

The function of the longitudinally extended primary die land is to cool the primary extruded product, or at least an outer surface region thereof, to reduce or maintain the temperature thereof below a critical temperature (the solidus temperature of its lowest melting phase) prior to extrusion through the secondary die. In most cases, and when not otherwise stated, we mean the solidus temperature at atmospheric (i.e. ambient) pressure. In some instances, however, it is enough to prevent melting in the primary die by cooling below the solidus at the elevated in situ pressure and subsequently cooling further in the secondary die.

The friction caused by the high rate extrusion and metal-to-metal contact may cause the temperature of the primary extruded product to temporarily increase above the critical temperature at least at localized regions near its surface in contact with the primary die. As described later, the back pressure resulting from the second reduction tends to prevent the circumferential cracking from taking place or from growing in these high temperature regions until the cooling in the primary die land can bring the temperature under the critical level. The ability to maintain or reduce the temperature of the extruded product below the critical level depends among other things on the length of the primary die land, and for a solid round product, its length-to-diameter ratio. The length of the primary die land to the thickness of the product might be a more accurate factor for a tubular or thin-section product.

The length of the primary die land should be selected as short as possible to reduce friction yet still long enough to enable control of the temperature of the extrusion as required. Land lengths of about 2.0–5.0 cm (0.75–2.0in) were required in our experiments with 1.27 cm (0.5 in) diameter solid rod and using water-cooled channels around the die land. In the case of solid round products, a length-to-diameter ratio between about 1:1 and 12:1 preferably 1:1 to 1:5, may be used successfully. Higher ratios may promote cooling but may also result in excessive friction and extrusion pressure. Lower ratios may not provide enough cooling, thus necessitating slower extrusion speeds in order to prevent hot-short cracking. Appropriate primary die land lengths may be easily selected for other shaped products to control the temperature below the critical level.

SECONDARY EXTRUSION DIE

The secondary extrusion die has a die land which may be conventional for the alloy extruded, for example, in the range of about 1:6–3.2 mm (0.063–1.125 in). A shorter land might, of course, be weaker or less dimensionally stable whereas a longer land would increase friction and possibly cause more surface defects. Preferably, the secondary die land is as short as structurally possible with a relief area downstream thereof. The secondary die land may be cooled (and may be longer) if required to further decrease the temperature of the product.

The secondary reduction effects the back pressure in the primary reduction die and particularly near the primary die face and in the cooled primary die land, which is used herein to reduce tensile stresses in the primary die and prevent hot-short cracks from initiating or from growing. The back pressure also forces the metal alloy against the primary die land surface to assure good contact for efficient cooling of the primary extrusion product below the critical temperature prior to extrusion through the secondary die. Moreover, the back pressure may prevent or reduce melting by maintaining the solidus temperature in the primary die region above its value at atmospheric pressure. The back pressure can thereby enable raising the billet preheat temperature above normal levels and still prevent later melting in the die region.

We have found that even small reductions (over the short longitudinal dimension) are useful for the purpose but that a $\frac{1}{4}$–60% reduction in cross-sectional area of the primary extrusion product by the secondary extrusion die is a practical range. We prefer a reduction of about 2–50%, and more preferably 2–15%, in the cross sectional area. Even if the secondary die face tapers, the longitudinal length of the die face and land is preferably minimized in order to minimize friction. Therefore, we prefer that larger secondary reductions be carried out in dies with less taper (larger included angles). Larger reductions or longer lands also require higher pressures and are therefore not preferred.

TUBULAR PRODUCTS

The CDR die can easily be adapted to multiple extrusions and to a variety of commonly extruded shapes. In particular, FIG. 3 discloses the die design for extruding tubular products. A porthole mandrel could also be used, but for seamless tubing, a fixed mandrel 20 having an enlarged region 21 is conventionally used to make a primary extrusion 22 and final tube product 23. The mandrel is preferably cooled with fluid flow through internal channels (not shown).

COOLING

It is, of course, conventional to extrude a billet into an extruded product with the temperature of the billet and of the extruded product at the die exit below the solidus temperature of the lowest melting phase at atmospheric pressure. However, the present inventors have found that benefits in extrusion rates and pressures may be gained from using a double-reduction die and in cooling the primary extrusion product. As shown in FIG. 1, cooling may be provided to the primary die land by means of cooling channels 10, located either in the die block 13 or on the outer surface of dies 4 and 6, and having an entrance 11 and exit 12. The cooling channel is shown as a helix surrounding the primary die land.

Cooling fluid such as water may be used or, in order to shorten the die land, a lower temperature liquid such as liquid nitrogen could be used. Other conventional cooling means may be used with the purpose of extracting heat from the primary and secondary die lands and thereby indirectly cooling the extrusion product passing therethrough.

The cooling preferably begins near the entrance to the primary die land. Some cooling of the billet may occur by contact with the primary die face, yet this may be beneficial so long as the extent of billet cooling does not raise the extrusion pressure to an unacceptable level. In some cases, for example with alloy materials which can temporarily be heated in the billet region above the critical temperature without irreversible damage, it may be desirable to minimize extrusion pressures by not allowing the billet to cool through the primary die face. In such cases, insulation may be provided between the die block 13 and the billet 15 to maintain the difference in temperature therebetween. The length of the cooling channels, the flow rate of liquids, the temperature of the liquids and all other parameters are all conventionally controlled to produce the desired temperature below the critical temperature in the primary extruded product or the outer surface portion thereof prior to extrusion through the secondary die.

In the preferred method of practicing the invention, the temperature of the primary extruded product or at least a surface region thereof, is cooled to reduce or maintain the temperature below the solidus temperature at atmospheric pressure of its lowest melting phase prior to secondary extrusion. The cooling may be such that additional heat resulting from the secondary reduction still does not raise the temperature above the solidus at atmospheric pressure. In this case, the secondary die need only be cooled to minimize pickup. If the heat would raise the temperature above the critical level, then the secondary die should also be cooled enough to prevent the temperature increase.

Some metals are irreversibly damaged by melting of the lowest melting phase such that the temperature in the billet and die region should be depressed at all times below the solidus at the in situ pressure. In other materials, the temperature may temporarily exceed the solidus with little or no permanent damage prior to being cooled below the critical level.

Though not preferred, it may be possible to merely cool the primary extruded product to below its solidus temperature at the in situ pressure (but above the solidus at atmospheric pressure) in the primary die prior to secondary extrusion. It would still be possible to utilize the secondary reduction to prevent or reduce cracking according to the invention under this condition, however, unless the secondary extruded product is further cooled, the temperature of the product will exceed the solidus at the exit of the secondary die (to atmospheric pressure) and melting would occur. Therefore, under this condition the secondary die would have to be designed to further cool the product. This might require a longer secondary die—therefore more friction and higher extrusion pressures. Consequently, this method is not preferred and we would prefer to cool the product in the primary die below its solidus at atmospheric pressure.

LUBRICATION AND POLISHING

If the friction in the CDR die could be entirely eliminated, the back pressure could be transmitted without attenuation back to the primary extrusion product in the primary die land region. This would virtually prevent any cracks from forming. The present invention seeks to eliminate or at least minimize the friction so that cracks are prevented or, if initially formed, they are mended and healed in the primary reduction die prior to the secondary reduction. Polishing and lubrication of the die surfaces are therefore desirable in that they reduce friction.

Polishing of the die lands and die faces is routine and is done to a surface finish of less than about 0.25 μm (10 microinches) rms and preferably less than about 0.05 μm (2 microinches) rms. Lubrication may then be applied to prevent or minimize the metal-to-metal contact in the die and the consequent adherence of the extruded product to the die surface. Lubricants such as graphite or molybdenum disulfide in resin carriers can be used along with a variety of other known lubricants which are adapted to the specific extruded alloys. The extrusion die could also be surface treated or impregnated, for example, by nitriding, chromizing, boronizing, to obtain a surface which is less prone toward metal pickup from the extruded product.

Except for such surface treated layers, the materials used in fabricating the CDR die can be conventional, for example, AISI H-11 or H-13 (hot-work) tool steels. Likewise, the dies could also be made with any other suitable materials such as tungsten carbide or other wear-resistant materials known to be resistant to metal pickup from the extruded product.

EXAMPLES OF THE PREFERRED EMBODIMENTS

EXAMPLE 1

Several extrusions of nominal 1.27 cm-diameter (0.5 in) rod were made from a 7.62 cm-diameter (3 in), 2024 aluminum alloy billet through both a 1.27 cm-diameter (0.5 in) conventional die (2.5 mm land length, 0.1 inch) and through a CDR die at an extrusion ratio of 36:1. The CDR die had a 1.27 cm-diameter (0.5 in) by 3.81 cm (1.5 in), long primary die land and a 10% (cross-sectional area) secondary reduction over a 2.5 mm (0.1 in) land length. All die faces were without taper. Results are shown in Table 1 under stated conditions. Cooling was provided as shown in FIG. 1 using chilled water at about 5° C. Long lands were polished and lubricated with a molybdenum disulfide-base material.

TABLE 1

| Trial No. | Die Design | Billet Temp. (°C.) | Product Speed (m/min) | Ram Speed (mm/sec) | Surface Condition Hot-Short Cracking |
|---|---|---|---|---|---|
| 24 | CDR | 375 | 18.3 | 8.5 | slight/ moderate |
| 25 | CDR | 375 | 18.3 | 8.5 | none |
| 28 | CDR | 425 | 18.3 | 8.5 | none |
| 31 | conventional | 425 | 18.3 | 8.5 | severe |
| 4 | conventional | 450 | 1.5 | 0.7 | none |
| 2 | conventional | 450 | 7.6 | 3.5 | moderate/ severe |
| 14 | CDR | 450 | 18.3 | 8.5 | slight/ moderate |
| 5 | conventional | 475 | 1.5 | 0.7 | none |
| 12 | CDR | 475 | 18.3 | 8.5 | slight |

Generally practiced exit speeds for extrusion of 2024 aluminum rod are between about 1–1.5 m/min (product rate). Our trials at 450° C. billet temperature showed that good product could be obtained with the conventional die at 1.5 m/min (5 fpm), but at 7.6 m/min (25 fpm) the product was moderately to severely hot-short cracked. At 18.3 m/min (60 fpm) and 425° C. billet temperature the conventionally extruded product was severely hot-short cracked.

On the contrary, using the CDR die between 375° C. and 450° C., the product could be produced with slight or no hot-short cracking even at 18.3 m/min. At 475° C., the product did show slight heat checking at the same rate.

During the course of experimenting with the CDR die it was found that the billet nose could be excessively chilled by the cooling media around the primary die. This would manifest in a higher pressure to cause breakthrough, poor surface on the extruded products and would generally disrupt the beginning of each extrusion. This excessive billet-nose chilling could be prevented by beginning the extrusion prior to commencing cooling of the primary die or by providing insulation between the die and the billet. After breakthrough, the cooling should be adjusted during extrusion to the level which maintains the critical temperature of the product entering the seconary die.

EXAMPLE 2

During the above trials it was also found that additional polishing and lubrication could improve the results with the CDR die. Friction should be reduced as much as possible. To prove this, and to show the advantage of the double reduction, several trials were made using the CDR die with a 10% secondary reduction and two other dies with extended die lands, one with a straight wall and no secondary reduction and the other with converging walls toward the exit end. The convergence was such that the cross-section of a 1.27 cm (0.5 in) product would be gradually reduced an additional 10%, to produce a product similarly sized with the product produced with the CDR die. The data are shown in Table 2. A 2024 aluminum alloy material was again used. The long primary die lands were polished to less than 0.05 μm (2 microinches) rms and lubrication was applied. The lubricating compound was Renite R-Seal AKW available from the Renite Company (Columbus, Ohio). This material is a graphited lubricant in an alkaline silicate binder and is applied and baked on the dies. We have not tried to optimize the lubricant and others may be equally good or better.

TABLE 2

| Trial No. | Die Design | Billet Temp. (C.°) | Product Speed (m/min) | Pressure Break (MPa) | Pressure Run (MPa) | Comments/ Surface Condition |
|---|---|---|---|---|---|---|
| 58 | CDR | 375 | 18.3 | 990 | 690 | Slight checking only near score mark |
| 59 | Straight | 375 | 18.3 | 1000 | — | Stick/slip, damaged product |
| 55 | CDR | 400 | 18.3 | 960 | 760 | Fine uniform checking |
| 56 | Converging | 400 | — | 1470 | — | No product |
| 57 | Straight | 400 | 18.3 | 830 | 600 | Moderate uniform checking |
| 60 | CDR | 400 | 18.3 | 950 | 800 | Slight checking only near score mark |
| 61 | Converging | 400 | — | 1470 | — | No product |
| 62 | Straight | 400 | 18.3 | 970 | 620 | Moderate uniform checking |
| 52 | CDR | 425 | 18.3 | 950 | 720 | Fine uniform checking |
| 53 | Straight | 425 | 18.3 | 770 | 620 | Moderate uniform checking |
| 54 | Straight | 425 | — | 1470 | — | No lubrication; no product |
| 51 | Straight | 425 | — | 1470 | — | 15 microinch polish, no lubrication; no product |

The converging die (Trials #56 and #61) was used to demonstrate the necessity of reducing friction, contrary to the suggestion of German Patentschrift No. 429,376. The converging die caused such high pressures that no useful product was obtainable under these conditions. The straight die (without second reduction) also produced no product because of high friction under the conditions of no lubrication (Trial #54) and no special polishing and no lubrication (Trial #51).

Even with polishing and lubrication, the straight die generally produced product with moderate surface checking at the 18.3 m/min. rate (Trials #53, #57, #59 and #62). The CDR die of the present invention, however, produced generally good product with either fine checking or with no checking except that associated with a stray score mark (Trials #52, #55, #58 and #60).

Routine experimentation with the polished and lubricated CDR die can locate the optimum billet temperature and cooling rate for a particular alloy and extrusion speed which will produce good product at rates significantly greater than conventional rates.

The novel die and method are preferably used to extrude hot-short-sensitive alloys and we have, therefore, accentuated this use herein. However, it is also intended to include other metals which can also be extruded according to the invention with several other benefits.

For example, the relatively high-melting-point metals such as titanium, zirconium, tantalum, tungsten, molybdenum, beryllium and their alloys, steel and copper, as well as superalloys of nickel, chromium, or cobalt, ordinarily are extruded at high temperatures, e.g. above 540° C. (1004° F.) and thus can cause severe die wear in ordinary dies made from the typical hot-work tool steels such as the AISI, H11, H12, and H13 types.

The present invention improves die life because of lower die temperatures within the primary and secondary die regions and, even if the primary die wears similarly to prior art single dies, the secondary die of the present invention will maintain its initial dimensions, surface finish, and hardness much longer than the primary die. Both the reduced temperature of the extruded product, or at least the surface thereof, as it approaches the secondary die and the secondary die itself contribute to maintaining these important qualities in the die much longer than would be possible in prior art single dies. It is mainly these retained qualities that result in improved surface finish and dimensional accuracy of the extruded product. Thus, any product surface roughness and/or loss of dimensional accuracy resulting from the normal amount of wear experienced in prior art single dies or the primary portion of the CDR die will be improved upon passing through the cooled secondary die. Also, by keeping the product reduction made by the secondary die relatively small (e.g., less than about 20%), the pressure developed in the secondary die can be minimized. This further minimizes die wear and extends the life of the secondary die. In addition, because the secondary die is able to properly size the product extruded from the primary die, the latter can be used for many more extrusion cycles than would be possible otherwise with a prior art single die.

Moreover, the CDR die may also allow the use of lower-melting-point, lower-viscosity glass lubricants than are normally used in conventional hot extrusion of these high-melting-point metals and alloys. Use of less viscous glasses or even grease-type lubricants, although they may contribute to greater wear of the primary die, may be preferred over the relatively higher-viscosity glasses. High-viscosity glasses tend to promote rougher finishes on extruded surfaces. Also such a glass would tend to solidify and accummulate in the cooled primary die land, thus further roughening the extruded surface. However, lower-viscosity glasses or grease-type lubricants would not solidify in the cooled primary die land and would therefore still function very effectively, thus contributing to an improved surface finish of the extruded product.

We claim:

1. A method for extruding products from a metal billet at higher than conventional rates and/or at lower extrusion pressures than for single dies while maintaining a good surface finish, comprising (a) extruding a primary extrusion product from the billet through a primary reduction die having an extended land, (b) cooling at least an outer surface region of the primary extrusion product over substantially the entire extended land to reduce or maintain the temperature thereof below the solidus temperature at atmospheric pressure of the lowest melting phase prior to a second reduction, and (c) extruding the cooled primary extrusion product through a secondary reduction die and maintaining the temperature of at least a substantial portion of the primary extrusion product above the recrystallization temperature, and producing a back pressure on the metal alloy in the primary reduction die sufficient to keep the primary extrusion product in contact with the extended primary die land and to reduce tensile stresses therein.

2. The extrusion method of claim 1 which further comprises cooling the secondary die such that the temperature of at least an outer surface portion of the extruded product from the secondary die is maintained below the solidus temperature at atmospheric pressure of the lowest melting phase after the second reduction.

3. The extrusion method of claim 1 which comprises lubricating the primary die land prior to extrusion to reduce friction therein.

4. The extrusion method of claim 1 wherein the cooled primary extrusion product is reduced by $\frac{1}{4}$–60% in cross-sectional area by the secondary reduction.

5. The extrusion method of claim 4 wherein the cooled primary reduction product is reduced by 2–50% in cross section by the secondary reduction.

6. The extrusion method of claim 1 wherein the primary extrusion product is indirectly cooled through the extended primary die land by fluid circulating in cooling channels surrounding the extended land.

7. The extrusion method of claim 1 for extruding solid rod wherein the extended primary die land has a length-to-diameter ratio of between about 1:1 and 12:1.

8. A method for extruding products from an elevated temperature billet of hot-short-sensitive metal alloy at higher than conventional rates and/or at lower extrusion pressures than for single dies while maintaining a good surface finish, comprising (a) extruding a primary extrusion product from the billet through a primary reduction die having an extended land and producing an elevated in situ pressure on the primary extrusion product within the primary die, (b) cooling at least an outer surface portion of the primary extrusion product over substantially the entire extended land to reduce or maintain a temperature therein below the solidus temperature at the in situ pressure of the lowest-melting phase prior to a second reduction, (c) extruding the cooled primary extrusion product through a secondary die and maintaining the temperature of at least a substantial portion of the primary extrusion product above the recrystallization temperature and producing a back pressure contributing to the in situ pressure on the metal alloy in the primary reduction die sufficient to keep the primary extrusion product in contact with the extended primary die land and to reduce the tensile stresses therein, and (d) cooling the extruded product in the secondary extrusion die such that the temperature of at least an outer surface portion thereof is below the solidus temperature at atmospheric pressure of the lowest-melting phase after the second reduction.

9. The extrusion method of claim 8 wherein the cooled primary extrusion product is reduced by $\frac{1}{4}$–60% in cross-sectional area by the secondary reduction.

10. The extrusion method of claim 8 which further comprises polishing to a finish of less than about 0.05 microns rms variation and lubricating to decrease friction the primary and secondary die lands and die faces.

11. A method for extruding products from an elevated-temperature billet of hot-short-sensitive metal alloy at higher than conventional rates and/or at lower extrusion pressures than for single dies while maintaining a good surface finish, comprising (a) extruding a primary extrusion product from the billet through a primary reduction die having an extended land, (b) cooling at least an outer surface region of the primary extrusion product over substantially the entire extended land to reduce or maintain the temperature thereof below the solidus temperature at atmospheric pressure of the lowest-melting phase prior to a second reduction, (c) extruding the cooled primary extrusion product through a secondary reduction die and maintaining the temperature of at least a substantial portion of the primary extrusion product above the recrystallization temperature and producing a back pressure on the metal alloy in the primary reduction die sufficient to keep the primary extrusion product in contact with the extended primary die land and to reduce tensile stresses therein, and (d) cooling an outer surface portion of the extruded product in the secondary die below the solidus temperature at atmospheric pressure of the lowest-melting phase while maintaining an interior portion thereof above the solidus temperature.

* * * * *